US008525090B1

(12) United States Patent
Cahayla

(10) Patent No.: US 8,525,090 B1
(45) Date of Patent: Sep. 3, 2013

(54) PNEUMATICALLY ACTUATED CONTROL SURFACE FOR AIRFRAME BODY

(75) Inventor: Jason R. Cahayla, West Milford, NJ (US)

(73) Assignee: The United States of America as Represented by the Secretary of the Army, Washington, DC (US)

( * ) Notice: Subject to any disclaimer, the term of this patent is extended or adjusted under 35 U.S.C. 154(b) by 353 days.

(21) Appl. No.: 12/821,315

(22) Filed: Jun. 23, 2010

(51) Int. Cl.
*F42B 15/01* (2006.01)

(52) U.S. Cl.
USPC ..... 244/3.27; 244/3.26; 244/99.12

(58) Field of Classification Search
USPC ..... 244/3.26, 3.27, 99.12, 3.24; 102/501
IPC ..... F42B 15/01
See application file for complete search history.

(56) References Cited

U.S. PATENT DOCUMENTS 4,410,151 A * 10/1983 Hoppner et al. ..... 244/63
4,471,923 A * 9/1984 Hoppner et al. ..... 244/63
4,512,537 A * 4/1985 Sebestyen et al. ..... 244/3.21
4,876,906 A * 10/1989 Jones ..... 74/89.25
5,098,043 A * 3/1992 Arena ..... 244/215
5,143,320 A * 9/1992 Boyadjian ..... 244/3.21
5,211,358 A * 5/1993 Bagley ..... 244/3.27
6,308,632 B1 * 10/2001 Shaffer ..... 102/388
7,070,144 B1 * 7/2006 DiCocco et al. ..... 244/3.21
8,193,476 B2 * 6/2012 Olden et al. ..... 244/3.27
2006/0237580 A1 * 10/2006 Cuccias et al. ..... 244/1 N
2010/0032516 A1 * 2/2010 Olden et al. ..... 244/3.27
2010/0275805 A1 * 11/2010 Rastegar et al. ..... 102/501
2011/0240793 A1 * 10/2011 Funis et al. ..... 244/3.24
2012/0187235 A1 * 7/2012 Bergmann et al. ..... 244/3.22

* cited by examiner

*Primary Examiner* — Son T Nguyen
*Assistant Examiner* — Shadi Baniani
(74) *Attorney, Agent, or Firm* — Michael C. Sachs

(57) ABSTRACT

A projectile may include a body having an external surface, a stagnation port on the external surface, and a cavity. A spoiler may be translatable in the cavity between a retracted position, wherein the spoiler is substantially completely disposed in the cavity, and an extended position, wherein the spoiler projects from the external surface of the body. A pair of ports may be formed in the walls of the cavity. The pair of ports may be selectively fluidly communicable with the stagnation port. The spoiler may be translatable by pressurizing one of the pair of ports with compressed air and venting the other of the pair of ports. In the extended position, the spoiler may disturb an airstream around the projectile to induce a guidance maneuver for the projectile.

5 Claims, 3 Drawing Sheets

FIG. 3
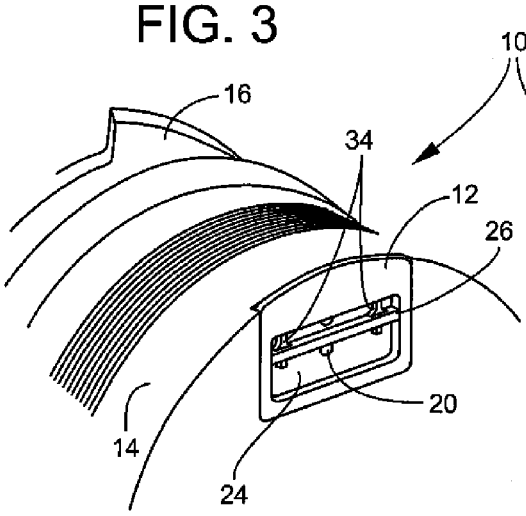
FIG. 4
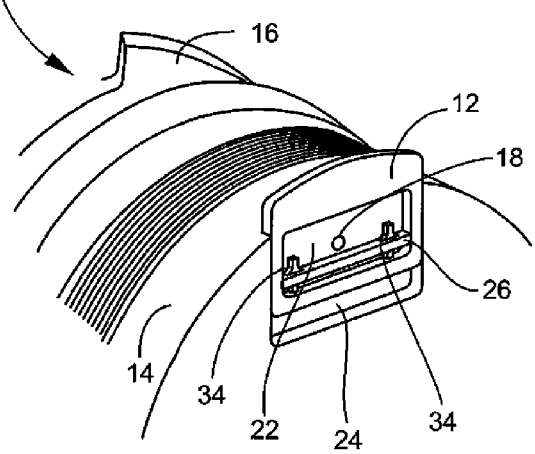
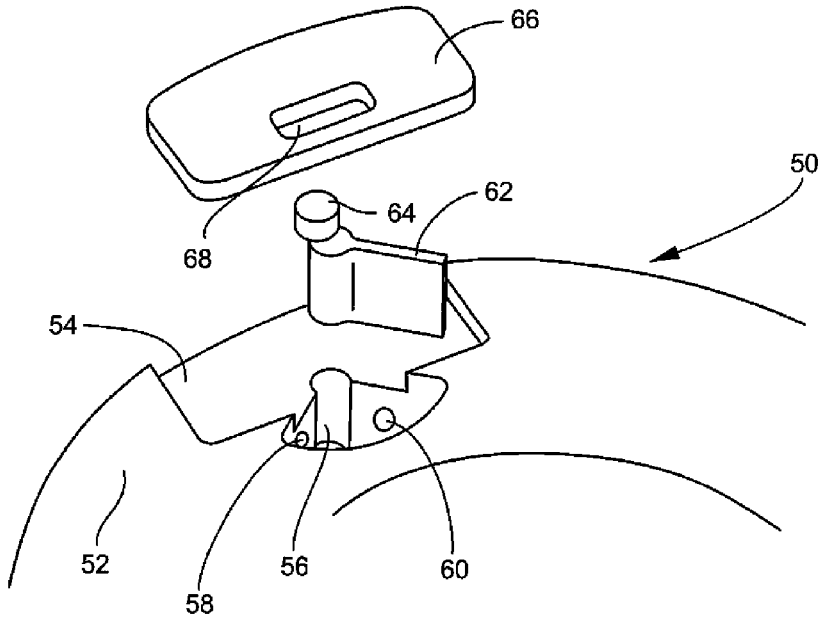
FIG. 5

FIG. 6
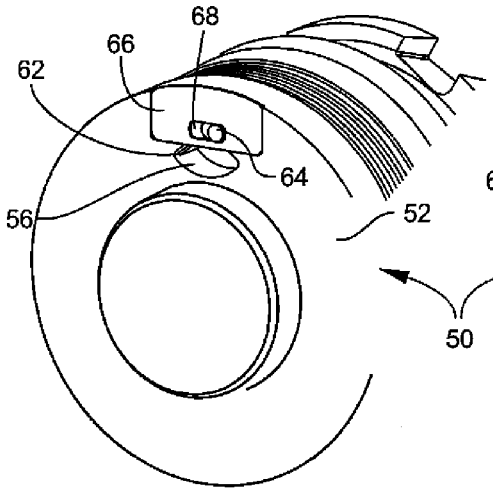
FIG. 7
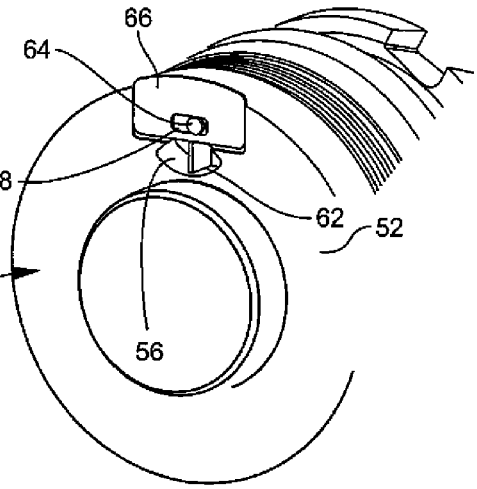
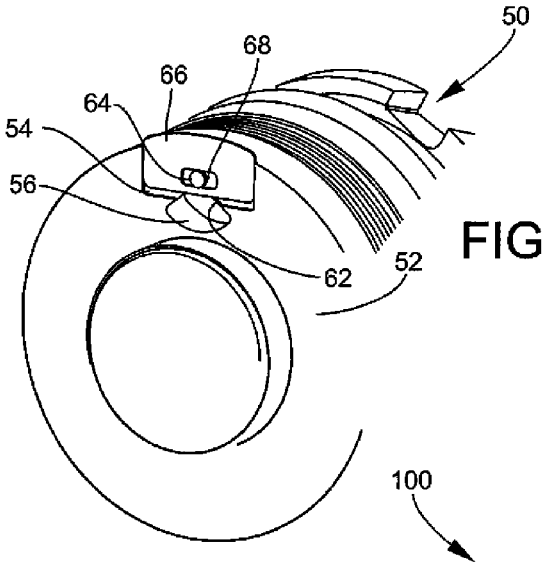
FIG. 8
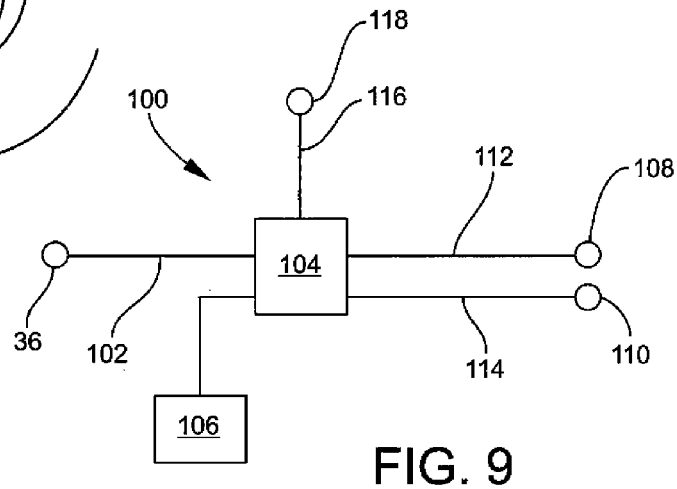
FIG. 9

PNEUMATICALLY ACTUATED CONTROL SURFACE FOR AIRFRAME BODY

STATEMENT OF GOVERNMENT INTEREST

The inventions described herein may be manufactured, used and licensed by or for the U.S. Government for U.S. Government purposes.

BACKGROUND OF THE INVENTION

The invention relates in general to airframe bodies and in particular to the guidance and control of airborne projectiles.

Numerous devices are known for the control and/or guidance of airframe bodies, such as projectiles. Steering devices for projectiles, for example, movable wings, flaps, and spoilers, may provide a disturbance to the airstream fluid flow path. By disturbing and redirecting the fluid flow path, a reactive moment is generated and imposed on the airframe body. The reactive moment may alter the angle of attack of the body, thereby changing the original flight trajectory.

Mechanical and electrical devices, such as hydraulic and electromagnetic systems, may actuate control surfaces on an airframe and direct the control surfaces into the airstream to provide a fluid flow disruption. Many guidance and control systems are expensive, complex, and may be difficult to package within the constraints of smaller projectiles. Hydraulic systems may not be feasible for smaller airframes due to space limitations, complexity, and cost.

Electromagnetic systems, particularly those using electromagnetic solenoids, may only be able to operate effectively at a lower frequency rate in the 1-15 Hz range. Such an electromagnetic system may drastically lose performance capability at frequency rates above approximately 25 Hz. Electromagnetic solenoids may require high power batteries to operate efficiently. Also, electromagnetic solenoids may only be able to actuate in one direction and may rely on a spring or other such device to return the solenoid to its home position.

A need exists for a control surface and actuator for an airframe body that may be simpler and less expensive than known control surfaces and actuators.

SUMMARY OF THE INVENTION

It is an object of the invention to provide a pneumatically actuated control surface for an airframe body.

In one aspect of the invention, a projectile may include a body having an external surface, a stagnation port on the external surface, and a cavity. A spoiler may be translatable in the cavity between a retracted position wherein the spoiler is substantially completely disposed in the cavity and an extended position wherein the spoiler projects from the external surface of the body.

A pair of ports may be formed in walls of the cavity. The pair of ports may be selectively fluidly communicable with the stagnation port. The spoiler may be translatable by pressurizing one of the pair of ports with compressed air and venting the other of the pair of ports.

The projectile may include fins formed on a rear portion of the projectile. The spoiler may be located forward of the fins.

A separation member may divide the cavity into an extend cavity and a retract cavity. The separation member may include stops that protrude into the extend cavity and the retract cavity. One of the pair of ports may be in fluid communication with the extend cavity and another of the pair of ports may be in fluid communication with the retract cavity.

In one embodiment, the spoiler may include an extend piston surface, a retract piston surface, and an opening between the extend piston surface and the retract piston surface. Pressure applied to the extend piston surface may cause the spoiler to extend out of the cavity and pressure applied to the retract piston surface may cause the spoiler to retract into the cavity.

In another embodiment, the cavity may include a spoiler guideway and a vane guideway, and the projectile may include a rotary vane disposed in the vane guideway. The rotary vane may include an eccentric cam and the spoiler may include a cam guide. The eccentric cam may be disposed in the cam guide.

In another aspect of the invention, a method may include providing and launching a projectile. The airstream around the projectile may be disturbed to thereby induce a guidance maneuver for the projectile. The airstream may be disturbed by translating a spoiler from a retracted position to an extended position.

The invention will be better understood, and further objects, features, and advantages thereof will become more apparent from the following description of the preferred embodiments, taken in conjunction with the accompanying drawings.

BRIEF DESCRIPTION OF THE DRAWINGS

In the drawings, which are not necessarily to scale, like or corresponding parts are denoted by like or corresponding reference numerals.

FIG. 3 is a perspective view, partially cut away, showing the spoiler of FIG. 2 in a retracted position.

FIG. 4 is a perspective view, partially cut away, showing the spoiler of FIG. 2 in an extended position.

FIG. 5 is an exploded, perspective view of another embodiment of a projectile having a pneumatic guidance and control system.

FIG. 6 is a perspective view, partially cut away, showing the spoiler of FIG. 5 in a retracted position.

FIG. 7 is a perspective view, partially cut away, showing the spoiler of FIG. 5 midway between a retracted position and an extended position.

FIG. 8 is a perspective view, partially cut away, showing the spoiler of FIG. 5 in an extended position.

FIG. 9 is a schematic drawing of one embodiment of a pneumatic guidance and control system.

DETAILED DESCRIPTION OF THE PREFERRED EMBODIMENTS

A pneumatic actuation system may include a low-current electronic valve that may be used to activate a pneumatic actuator, such as a cylinder or rotary vane. The electromagnetic pneumatic valve that is used to actuate the pneumatic device may have low electric power consumption. Thus, the electromagnetic pneumatic valve may effectively reduce total overall electrical power requirement to a fraction of that required for a solenoid actuated system. A benefit of a pneumatic/electronic system may be a fast response time due to the electronically actuated valve. Another benefit may be a high force advantage due to pneumatic pressure acting on a piston/vane area. Electronic/pneumatic actuation may provide a compact, high speed, high powered system.

An airframe may operate through a transonic speed range and may be exposed to very high speed airstream velocities. The airframe or projectile may include a port that is exposed to the airstream. The exposed port may develop a stagnation pressure. The stagnation pressure is directly related to the fluid mechanics of the airstream and may be plumbed to a storage chamber. The storage chamber may function as a pressure source for a pneumatic actuator. Or, the stagnation pressure may be plumbed directly to a control valve for a pneumatic actuator. Air pressure may also be supplied by an onboard compressed air supply or gas generator.

When using airstream stagnation pressure for a pneumatic supply on an airframe, the supply may have a zero or near zero pressure prior to flight of the airframe. The pneumatic supply may become pressurized when the airframe is in flight and at a sufficient velocity.

Figure 1:
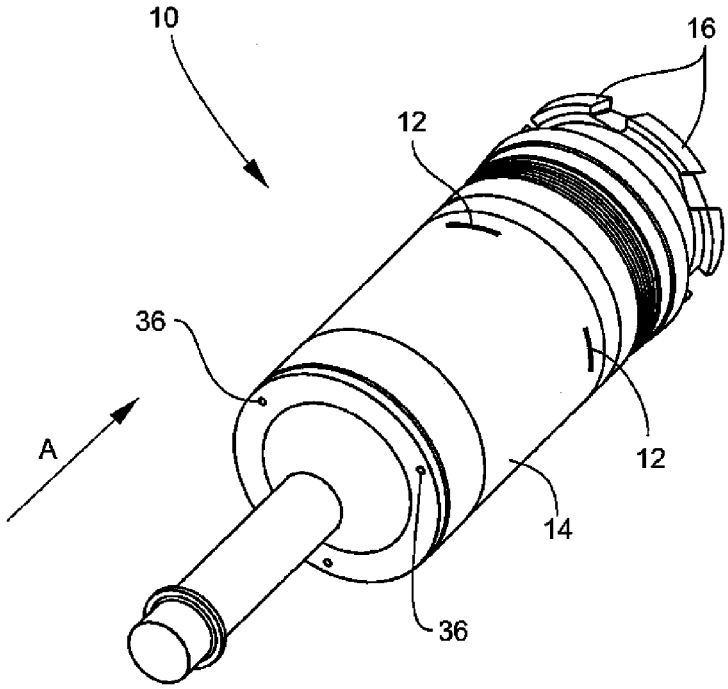
FIG. 1 is a perspective view of one embodiment of a projectile having a pneumatic guidance and control system.

FIG. 1 is a perspective view of an embodiment of projectile 10 having a pneumatic guidance and control system. Projectile 10 may be in an airstream flow A. Spoilers 12 (shown in a retracted position in FIG. 1) may be disposed toward the rear of the projectile main body 14. Spoilers 12 may be proximal to the rear fins 16 to thereby provide a close relationship between the spoilers 12 and the fins 16. Air pressure may be supplied via one or more stagnation ports 36 on body 14.

When one or more spoilers 12 are deployed, the resulting disturbance of the air flow A may affect the air flow across the portion of projectile body 14 to the rear of the spoiler 12 (towards the fins 16). The air flow disturbance may impart a moment to the projectile 10.

Figure 2:
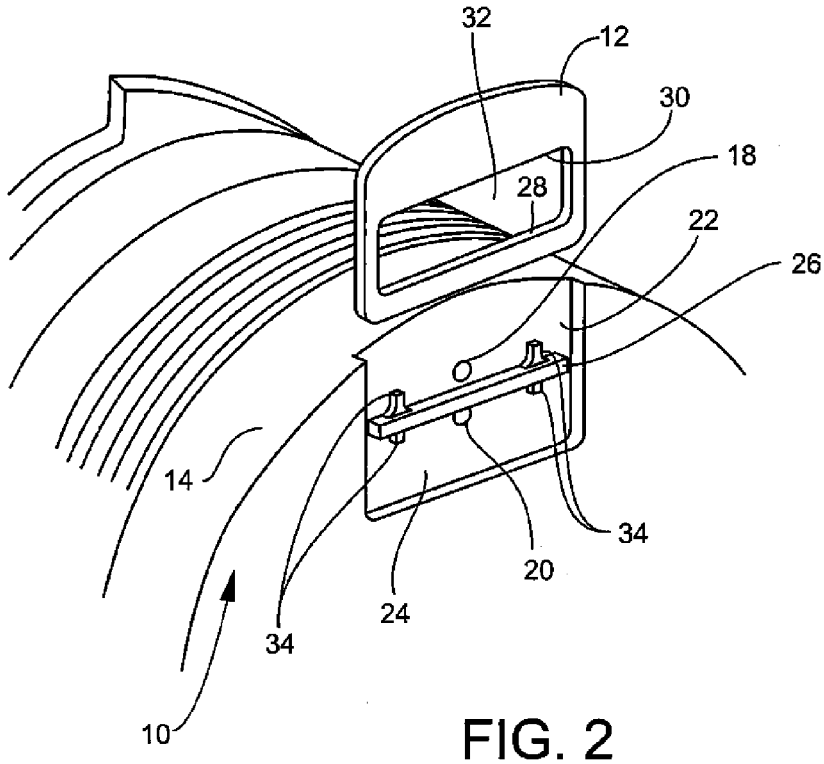
FIG. 2 is a perspective view, partially cut away, of the projectile of FIG. 1.

FIG. 2 is a perspective view, partially cut away, of the projectile 10 of FIG. 1. The main body 14 of the projectile may function as a housing to contain and seal the spoiler 12. In FIG. 2, the spoiler 12 is shown removed from the body 14 of the projectile 10. Body 14 may include a cavity having an extend cavity 22 and a retract cavity 24. The wall of the extend cavity 22 may include an extend port 18. The wall of the retract cavity 24 may include a retract port 20. Ports 18, 20 may allow pressurized air to alternately enter the respective cavities 22, 24.

Cavities 22, 24 may be separated from each other by a separation member 26. Separation member 26 may include stops 34 that extend into both the extend and retract cavities 22, 24. The portion of body 14 that is cut away in FIG. 2 may form the front wall of cavities 22, 24.

Spoiler 12 may function as both a piston and as a control device. Spoiler 12 may include a retract piston surface 28 and an extend piston surface 30. The retract piston surface 28 and the extend piston surface 30 may be separated by an opening 32. Spoiler 12 may be disposed in cavities 22, 24 such that the retract piston surface 28 is in retract cavity 24 and the extend piston surface 30 is in extend cavity 22.

FIG. 3 is a perspective view, partially cut away, showing the spoiler 12 of FIG. 2 in a retracted position. The extend cavity 22 (FIG. 4) may be pressurized by air supplied by extend port 18. Retract cavity 24 may be depressurized by venting through retract port 20 (FIG. 3). The pressurized air in cavity 22 acts on extend piston surface 30 of spoiler 12 to thereby translate spoiler 12 outward from the retracted position of FIG. 3 to an extended position shown in FIG. 4. Spoiler 12 may continue to move outward until retract piston surface 28 contacts stops 34 in retract cavity 24.

Similarly, when the extend port 18 is vented and the retract port 20 is pressurized, the spoiler 12 translates from the extended position of FIG. 4 to the retracted position of FIG. 3. The spoiler 12 may retract until the extend piston surface 30 contacts the stops 34 in the extend cavity 22.

FIG. 5 is an exploded, perspective, partially cut away view of another embodiment of a projectile 50 having a pneumatic guidance and control system. Projectile 50 may include a body 52. Body 52 may include a cavity having a spoiler guideway 54 and vane guideway 56. A spoiler 66 may translate in the spoiler guideway 54. A rotary vane 62 may rotate in the vane guideway 56. The vane guideway 56 may include an extend port 58 and a retract port 60. The extend and retract ports 58, 60 may be disposed on opposite sides of rotary vane 62.

The rotary vane 62 may include an eccentric cam 64. Eccentric cam 64 may be disposed in a cam guide 68 in spoiler 66. The eccentric cam 64 and cam guide 68 may transform the rotary motion of the rotary vane 62 to a linear displacement of the spoiler 66. Opposite sides of the rotary vane 62 may be pressurized with compressed air via the extend port 58 and the retract port 60. When one of the ports 58 or 60 is pressurized, the opposite port 58 or 60 is vented. Thus, the rotary vane 62 may be subject to a pressure differential.

The pressure differential on vane 62 may cause vane 62 to rotate. The eccentric cam 64 disposed in cam guide 68 may convert the rotary motion of the vane 62 to a linear displacement of the spoiler 66. In FIG. 6, the spoiler 66 is retracted. As the extend port 58 is pressurized pneumatically and the retract port 60 is vented, the rotary vane 62 sweeps across the vane guideway 56, rotating the eccentric cam 64 which is coupled to the spoiler 66 and extending the spoiler 66 into the airstream, as shown in FIG. 7. The spoiler 66 is shown completely extended in FIG. 8.

From the position shown in FIG. 8, if the retract port 60 in the vane guideway 56 is pneumatically pressurized while the extend port 58 is vented, the rotary vane 62 may sweep back toward the retracted position. Through the interaction of the eccentric cam 64 coupled to the cam guide 68 in spoiler 66, the spoiler 66 is also translated to the retracted position.

FIG. 9 is a schematic drawing of one embodiment of a pneumatic guidance and control system 100. System 100 may include a stagnation port 36 on the body of a projectile. The stagnation port 36 may be fluidly communicable via air line 102 to a multi-position valve 104. Valve 104 may be, for example, a four-way valve. Valve 104 may be controlled by a control unit 106, for example, a microprocessor. Valve 104 may be fluidly communicable with extend and retract ports 108, 110 via air lines 112, 114, respectively. A vent line 116 may lead from valve 104 to a vent port 118 on the exterior surface of a projectile. Vent port 118 may be located on the projectile at an area of pressure that is less than the stagnation pressure. If desired, an accumulator (not shown) may be disposed between stagnation port 36 and valve 104.

While the invention has been described with reference to certain preferred embodiments, numerous changes, alterations and modifications to the described embodiments are possible without departing from the spirit and scope of the invention as defined in the appended claims, and equivalents thereof.

What is claimed is:

1. An ammunition projectile, comprising:

a body having an external surface, and a cavity;

a spoiler that is translatable in the cavity between a retracted position wherein the spoiler is completely disposed in the cavity and an extended position wherein the spoiler projects from the external surface of the body; and wherein the cavity includes a spoiler guideway and a vane guideway, the projectile further comprising a rotary vane disposed in the vane guideway, wherein the rotary vane includes an attached eccentric cam and the spoiler includes a cam guide, the eccentric cam being disposed in the cam guide, and wherein the cavity includes a pair of ports disposed in the vane guideway, each port on an opposite side wall of said vane guideway, wherein compressed air pressure is selectively appliable to one or the other of the ports on one or the other side of the rotary vane and whereby said rotary vane is thereby selectively rotatable, and whereby said eccentric cam attached on said rotary vane is thereby also selectively rotatable therewith, and whereby said cam guide on the spoiler thereby is thereby also selectively movable in turn with the rotation of said eccentric cam, and wherein the spoiler is thereby effectively selectively translatable in turn by compressed air pressure applied on one of said ports to extend out of the spoiler guideway in the cavity and by compressed air pressure being applied on the opposite one of the said ports to retract the spoiler into the spoiler guideway in the cavity.

2. The projectile of claim 1, further comprising fins formed on a rear portion of the projectile wherein the spoiler is located forward of the fins.

3. The projectile of claim 1, wherein the body has a stagnation port proximate to the external surface, and wherein the pair of ports are selectively fluidly communicable with the stagnation port.

4. The projectile of claim 3, wherein compressed air pressure is directable to either or both ports in the vane guideway, through said stagnation port.

5. The projectile of claim 3, wherein the said stagnation port is on the external surface of said body.

* * * * *